US011105179B2

(12) United States Patent
Ringgenberg

(10) Patent No.: US 11,105,179 B2
(45) Date of Patent: Aug. 31, 2021

(54) TESTER VALVE BELOW A PRODUCTION PACKER

(71) Applicant: Halliburton Energy Services, Inc., Houston, TX (US)

(72) Inventor: Paul D. Ringgenberg, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 440 days.

(21) Appl. No.: 16/095,294

(22) PCT Filed: May 10, 2016

(86) PCT No.: PCT/US2016/031640
§ 371 (c)(1),
(2) Date: Oct. 19, 2018

(87) PCT Pub. No.: WO2017/196303
PCT Pub. Date: Nov. 16, 2017

(65) Prior Publication Data

US 2019/0136659 A1 May 9, 2019

(51) Int. Cl.

| | |
|---|---|
| ***E21B 17/00*** | (2006.01) |
| ***E21B 33/12*** | (2006.01) |
| ***E21B 33/124*** | (2006.01) |
| ***E21B 34/06*** | (2006.01) |

(Continued)

(52) U.S. Cl.
CPC ..... *E21B 33/1246* (2013.01); *E21B 17/003* (2013.01); *E21B 33/1208* (2013.01); *E21B 34/06* (2013.01); *E21B 49/008* (2013.01); *E21B 49/087* (2013.01)

(58) Field of Classification Search
CPC .. E21B 49/008; E21B 17/003; E21B 33/1208; E21B 33/1246; E21B 34/06; E21B 49/087
See application file for complete search history.

(56) References Cited

U.S. PATENT DOCUMENTS

| | | | |
|---|---|---|---|
| 3,233,453 | A | 2/1966 | Lebourg |
| 4,320,800 | A | 3/1982 | Upchurch |
| 4,553,428 | A | 11/1985 | Upchurch |

(Continued)

OTHER PUBLICATIONS

Korean Intellectual Property Office, International Search Report and Written Opinion, PCT/US2016/031640, dated Jan. 26, 2017, 18 pages, Korea.

(Continued)

*Primary Examiner* — Daniel P Stephenson

(57) ABSTRACT

A downhole tester valve disposed below an isolation member in a test string may facilitate a shut-in drill stem test procedure. The positioning of the tester valve allows the tester valve to remain in a static location when the test string above the isolation member expands or contracts. The volume of a wellbore interval below the isolation member may remain constant and pressure readings over the duration of a shut-in DST test period may effectively be monitored. The tester valve is operatively associated with a communication unit that permits selective activation of the tester valve from across the isolation member, and in some example embodiments, an actuator for operating the tester valve is also is also operable to set the isolation member in the wellbore.

20 Claims, 6 Drawing Sheets

(51) Int. Cl.
*E21B 49/00* (2006.01)
*E21B 49/08* (2006.01)

(56) References Cited

U.S. PATENT DOCUMENTS

| | | | | |
|---|---|---|---|---|
| 4,577,692 | A | 3/1986 | Reardon | |
| 4,898,236 | A | 2/1990 | Sask | |
| 4,979,569 | A | 12/1990 | Anyan et al. | |
| 5,117,685 | A | 6/1992 | Goldschild | |
| 5,226,494 | A | 7/1993 | Rubbo et al. | |
| 5,275,241 | A | 1/1994 | Vigor et al. | |
| 5,540,280 | A | 7/1996 | Schultz et al. | |
| 5,826,662 | A | 10/1998 | Beck et al. | |
| 8,620,636 | B2 | 12/2013 | Zhan et al. | |
| 2004/0094296 | A1* | 5/2004 | Richards | E21B 49/087 166/250.08 |
| 2010/0050762 | A1 | 3/2010 | Nold, III et al. | |
| 2011/0048122 | A1* | 3/2011 | Le Foll | E21B 49/00 73/152.55 |
| 2011/0168389 | A1 | 7/2011 | Meijs et al. | |
| 2012/0012312 | A1 | 1/2012 | Whitsitt et al. | |
| 2012/0090687 | A1 | 4/2012 | Grigsby et al. | |
| 2012/0305244 | A1 | 12/2012 | Atkinson et al. | |
| 2019/0136659 | A1* | 5/2019 | Ringgenberg | E21B 33/1246 |

OTHER PUBLICATIONS

Eastern Testing Services, Drill Stem Testing, Retrieved Nov. 2, 2018, 3 pages, https://www.eastern-testing.com/content.php?id=45.

Paul Riggenberg and John C. Self, Full-scale test help improve reliability of DST tools, Oil & Gas Journal, May 6-9, Aug. 5, 1996, 6 pages, 28$^{th}$ annual Offshore Technology Conference in Houston, Texas.

Kurt S. Abraham, Mark E. Teel, and T.R. Wright Jr., New technology is shaped by North Sea, subsea markets, World Oil, Jul. 1991, 12 pages.

* cited by examiner

TESTER VALVE BELOW A PRODUCTION PACKER

CROSS-REFERENCE TO RELATED APPLICATIONS

This application is a U.S. national stage patent application of International Patent Application No. PCT/US2016/031640, filed on May 10, 2016 the benefit of which is claimed and the disclosure of which is incorporated herein by reference in its entirety.

BACKGROUND

1. Field of the Invention

The present disclosure relates generally to downhole operations related to oil and gas exploration, drilling and production. More particularly, the disclosure relates to apparatuses and methods for testing a well by providing a tester valve with a shut-in feature below a production packer or other isolation element disposed in the wellbore.

2. Background

New exploration we bores are often tested to evaluate the surrounding geologic formation and to determine its commercial feasibility. A drill stem test (DST) generally involves a temporary completion that provides information useful in determining whether or not to complete the wellbore. The tests are typically performed using a DST tool that has downhole gauges installed thereon. The gauges are employed to detect and record downhole characteristics such as reservoir pressure, formation permeability, temperatures, flow rate, etc. during a series of flowing and shut-in tests. For a shut-in test, a lower interval of a wellbore may be isolated, or "shut-in," by a production packer sealing an annulus surrounding a test string and a tester valve closing a flow passage through the test string. Fluids from the lower interval are thereby prevented from flowing toward the surface. The fluid pressure in the lower interval is then monitored or recorded over a predetermined shut-in test period, which may range from several hours to several weeks.

One difficulty encountered when performing shut-in tests is that volume changes often occur in the lower interval during the shut-in test period. For example, the test string may cool down and contract during the test period. This contraction may result in an upward movement of both the tester valve and portion of the test string above the packer, which may, in-turn, cause a partial separation of the test string from the packer. An abrupt increase in the volume of the fluid in the lower interval, and a corresponding decrease in the pressure may occur several times during the shut-in period whenever the force of the contraction overcomes the static friction between the packer and the test string. These abrupt decreases in pressure frustrates the detection and analysis of a pressure build-up occurring in the in the lower interval.

BRIEF DESCRIPTION OF THE DRAWINGS

The disclosure is described in detail hereinafter, by way of example only, on the basis of examples represented in the accompanying figures, in which.

DETAILED DESCRIPTION

In the following description, even though a figure may depict an apparatus in a portion of a wellbore having a specific orientation, unless indicated otherwise, it should be understood by those skilled in the art that the apparatus according to the present disclosure may be equally well suited for use in wellbore portions having other orientations including vertical, slanted, horizontal, curved, etc. Likewise, unless otherwise noted, the figures may depict a wellbore extending from a terrestrial surface location, but aspects of the disclosure may be equally suited from in an offshore or subsea wellbore. Further, even though a figure may depict an open hole wellbore, it should be understood by those skilled in the art that the apparatus according to the present disclosure may be equally well suited for use in slotted liner or partially cased wellbores.

The present disclosure includes a downhole tester valve disposed below an isolation member in a test string. The positioning of the downhole tester valve below the isolation member allows the tester valve to remain in a static location when the test string above the isolation member expands or contracts. The volume of the wellbore interval below the isolation member and the tester valve may thus remain constant for the duration of a shut-in DST test period. The tester valve is operatively associated with a communication device that permits selective activation of the tester valve from across the isolation member, and in some example embodiments, an actuator for operating the tester valve is also is also operable to set the isolation member in the wellbore.

Figure 1:
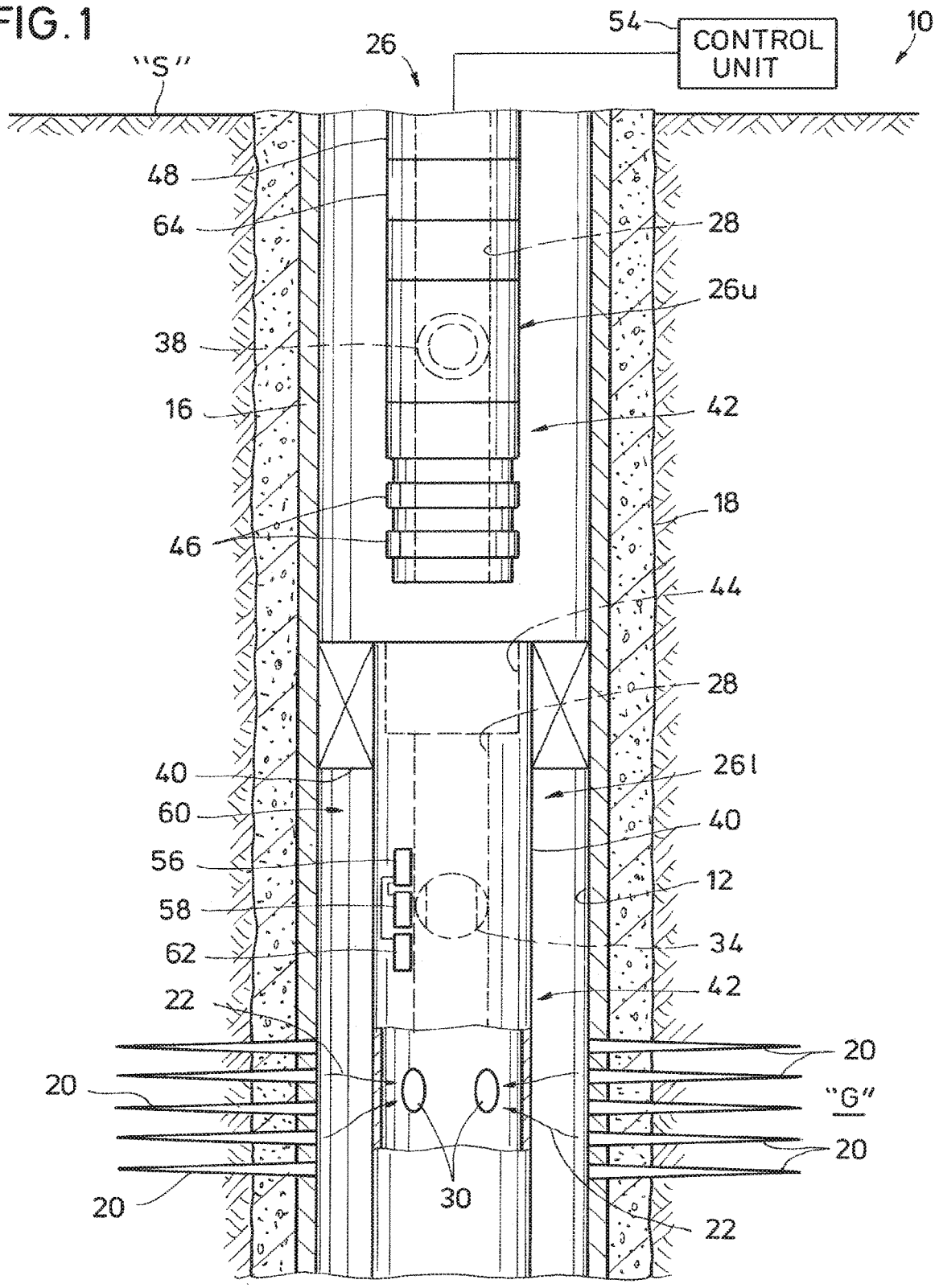
FIG. 1 is a partially cross-sectional side view of a well system including a tester valve positioned below a production packer and a seal assembly in a completion string that is operable for conducting shut-in drill stem testing.

FIG. 1 is side view of an example of a drill stem testing system 10 for evaluating a wellbore 12 extending through a geologic formation "G." In the illustrated example, the wellbore 12 is shown generally vertical, though it will be understood that the wellbore 12 may include any of a wide variety of vertical, directional, deviated, slanted and/or horizontal portions therein, and may extend along any trajectory through the geologic formation "G." The wellbore 12 may be lined with casing 16 and cement 18, with perforations 20 that extend into the geologic formation "G." The perforations 20 permit fluid 22 to flow from the geologic formation "G," through the cement 18 and casing 16, and into the wellbore 12. In other examples, at least portions of the wellbore 12 may not be lined with casing 16 and cement 18

(e.g., the wellbore 12 could be encased or open hole), and fluid 22 flows directly into the wellbore 12 from the geologic formation "G."

A generally tubular test string 26 is disposed in the wellbore 12 and provides a flow passageway 28 through which the fluid 22 may be conveyed toward a surface location "S." The test string 26 may be of the type known to those skilled in the art such as a work string, and may be comprised of tubular segments and/or continuous tubing, etc. Any types of tubular materials may be used for the tubular test string, including (but not limited to) tubulars known to those skilled in the art as production tubing, coiled tubing, composite tubing, wired tubing, etc. Openings 30 are provided in test string 26 to permit fluid 22 to enter the flow passageway 28 from the wellbore 12. A tester valve 32 is interconnected in the test string 26, and is operable to move between an open configuration where flow through the flow passageway 28 is permitted and a closed configuration where flow through the flow passageway 28 is prohibited. In the illustrated example, the tester valve 30 comprises a ball valve with a closure member 34 that rotates within the flow passageway 28 to move between the open and closed configurations. In other embodiments (see FIG. 2) the tester valve 30 may comprise a longitudinally sliding sleeve that seals and unseals the openings 30 to move between the closed and open configurations respectively.

A lower portion **26*l* of the test string 26 is supported in the wellbore 12 with an isolation member 40, which in some embodiments may include any type of production packer recognized in the art. For example, the isolation member 40 may include a mechanical set packer, hydraulic set packer, an elastomeric packer and/or an inflatable packer in exemplary embodiments. The isolation member 40 seals an annulus 42 defined around the test string 26 and secures the test string 26 in the wellbore 12. A seal bore 44 is provided within the isolation member 40 for receiving a pair of annular seals 46 disposed on an upper portion 26*u* of the test string 26. The seals 46 permit the flow passageway 28 extending longitudinally through the upper and lower portions 26*u*, 26*l* of the test string 26 to be sealed at the location of the isolation member 40, e.g., during DST testing of the geologic formation "G." The seal bore 44 may be sufficiently deep to accommodate a sliding seal to be established between the upper and lower portions 26*u*, 26*l* of the test string 26. For example, some longitudinal movement is permitted between the upper and lower portions 26*u*, 26*l* of the test string 26 without breaking the seal formed by the annular seals 46. Thus, the fluid passageway 28 may be maintained even when the upper portion 26*u* of the test string expands and contracts. The isolation member 40 and the tester valve 32 are both coupled in the lower portion 26*l* of the tubular test string 26 in a fixed spatial relation to one another, and thus there is no movement or relatively little movement between the isolation member 40 and the tester valve 32 as the upper portion 26*u* of the test string 26** moves longitudinally.

The upper portion **26*u* of the test string 26 may also have a circulating valve 48 and an upper valve 50 interconnected therein for use in testing the geologic formation "G," e.g., for establishing circulation through the test string 26 after DST testing, pressure testing the flow passageway 28 above the upper valve 50, etc. Suitable circulating valves include OMNI™, RTTS™ and VIPR™ circulating valves, marketed by Halliburton Energy Services, Inc. The upper valve 50 is illustrated as a ball valve that moves between closed and open configurations to restrict and permit flow through a portion of flow passageway 28 extending through the upper portion 26*u* of the test string 26**. Other types of circulating valves and/or upper valves may be used, and the use of circulating/and or upper valves is not necessary, in keeping with the scope of this disclosure.

The drill stem testing system 10 includes a surface control unit 54 and a downhole communication unit 56 communicatively coupled thereto. In the illustrated example, the surface control unit 54 and the downhole communication unit 56 are communicatively coupled by any of a number of wireless communication technologies including hydrophones or other types of transducers operable to selectively generate and receive acoustic signals that can be transmitted through a fluid in the wellbore 12. Suitable communication technologies may be incorporated in the ProPhase™ well test valve, marketed by Halliburton Energy Services, Inc. The downhole communication unit 56 may comprise other technologies to permit communication through the isolation member 40. For example, the communication unit may include an RFID reader operable to detect RFID tags carried by a drilling fluid conveyed through the flow passageway 28, an/or may comprise radio transmitters and receivers, infared LED transmitters and photoreceptors, microwave, Wi-Fi and/or other wireless telemetry tools as will be appreciated by those skilled in the art. The surface control unit 54 may employ any of the similar technologies for communicating with the downhole communication unit 56.

The down communication unit is operable to receive an instruction signal from above the isolation member 40 and respond by providing an instruction to an actuator 58 to move the tester valve 32 between the open and closed configurations. The actuator 58 may include electric, mechanical and/or hydraulic pistons, motors and/or other devices operable move the closure member 34 to permit and restrict flow through the flow passageway 28. A wellbore interval 60 defined below the isolation member 40 may thus be isolated or "shut in" (as described in greater detail below) by sending an instruction signal from the surface control unit 54 through the isolation member 40 to the downhole communication unit, and then in response to receiving the instruction signal at the downhole communication unit, providing an instruction signal to the actuator 58 to move the tester valve 32 to a closed configuration.

Sensors 62 are provided on the lower portion **26*l* of the test string 26 and are operable to detect a condition of the wellbore interval 60 below the isolation member 40. The sensors may include pressure sensors exposed to the downhole shut-in pressure to detect the shut-in pressure of the wellbore interval 60 during a test period. The sensors 62 may be operably coupled to the downhole communication unit 56 such that data from the sensors may be transmitted to the surface location during a shut-in test period. In other embodiments, the data may be stored in a memory (not shown), and retrieved from the wellbore 12 after the test period is complete. Other instruments for conducting DST testing may be provided on the upper portion 26*u* of the test string 26. For example, samplers 64** for collecting samples of wellbore fluids may be provided above the isolation member as fluid samples are often collected during a flow period rather than a shut-in test period.

Figure 2A:
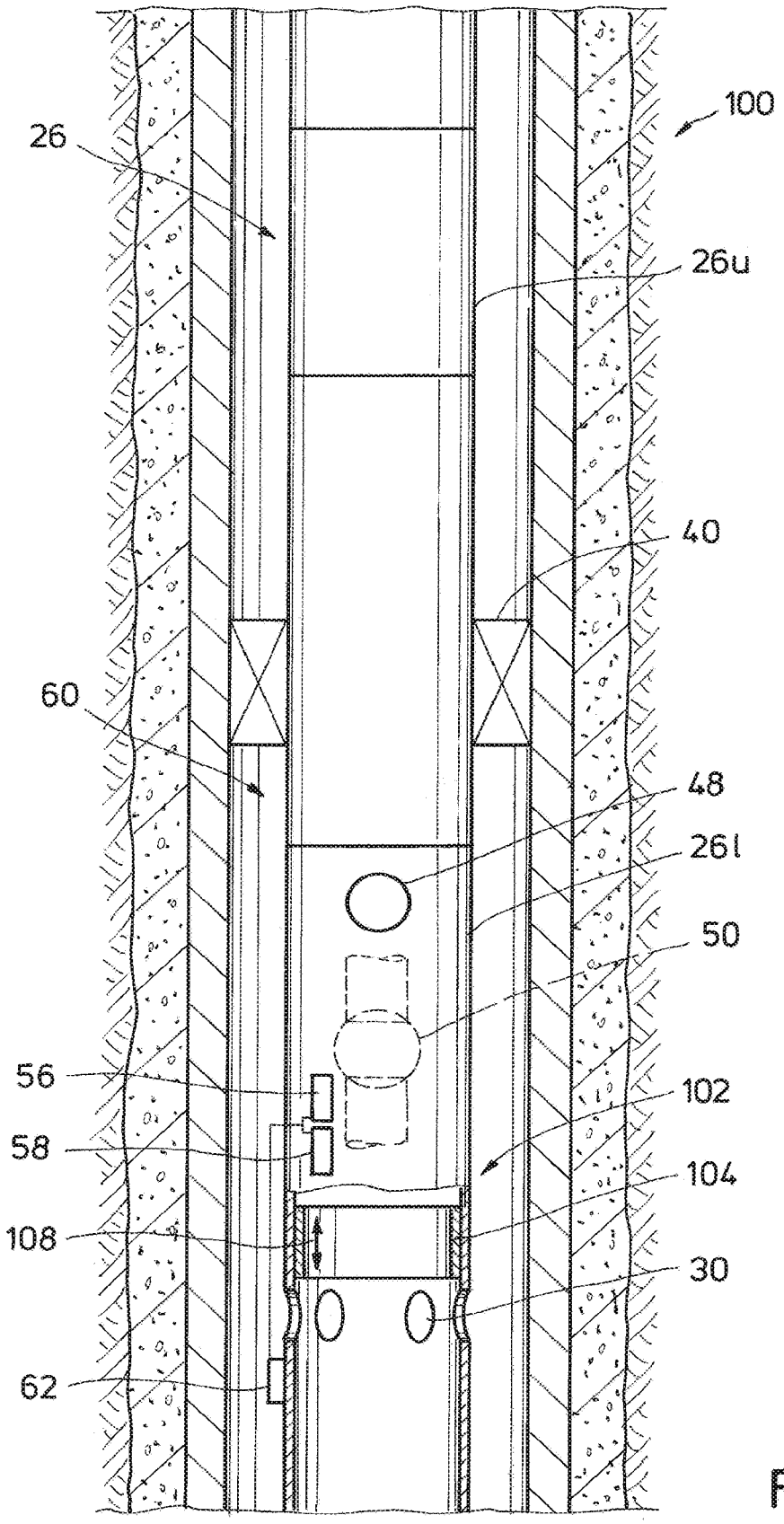
FIGS. 2A and 2B are partially cross-sectional side views of alternate well systems including a sliding sleeve valve that is selectively operable to prevent inflow of wellbore fluids into a test string below a production packer.

FIG. 2A is a partially cross-sectional side view of an alternate well system 100 including a tester valve 102 having a sliding sleeve 104 disposed below the isolation member 40. The sliding sleeve 104 is operably coupled to the downhole communication unit 56 such that the sliding sleeve 104 may be selectively controlled to prevent inflow of wellbore fluids into the test string 26 below isolation member 40. The sliding sleeve 104 is selectively movable by actuator 58 in a longitudinal direction (see arrows 108) between a first position (as illustrated) where the openings 30 are substantially un-obstructed and the tester valve 102 is in an open configuration, and a second position where the openings 30 are obstructed by the sliding sleeve 104 and the tester valve 102 is in a closed configuration. When the tester valve 102 is in the closed configuration, the wellbore interval 60 below the isolation member 40 may be shut-in. Sensors 62 are positioned again on the lower portion **26*l* of the test string 26 to be in communication with the shut-in pressure when the wellbore interval 60 is shut in. Alternatively, the sensors 62 may be deployed on a wireline or slickline tool (not shown), which may be particularly helpful when wireline or slickline deployed tools are planned for collecting fluid samples from the wellbore 12**.

The downhole communication unit 56 may also be operably coupled to additional valves useful in DST testing. A circulating valve 48 and/or an additional upper valve 50 may be operable by actuators (not shown) communicatively coupled to the downhole communication unit 56. In the example embodiment illustrated in FIG. 2A, the upper portion **26*u* of the test string 26 is sealed to the isolation member 40 (by annular seals 46, FIG. 1), and all of the valves useful for DST testing are positioned in the lower portion 26*l* of the test string 26 below the isolation member 40**.

Figure 2B:
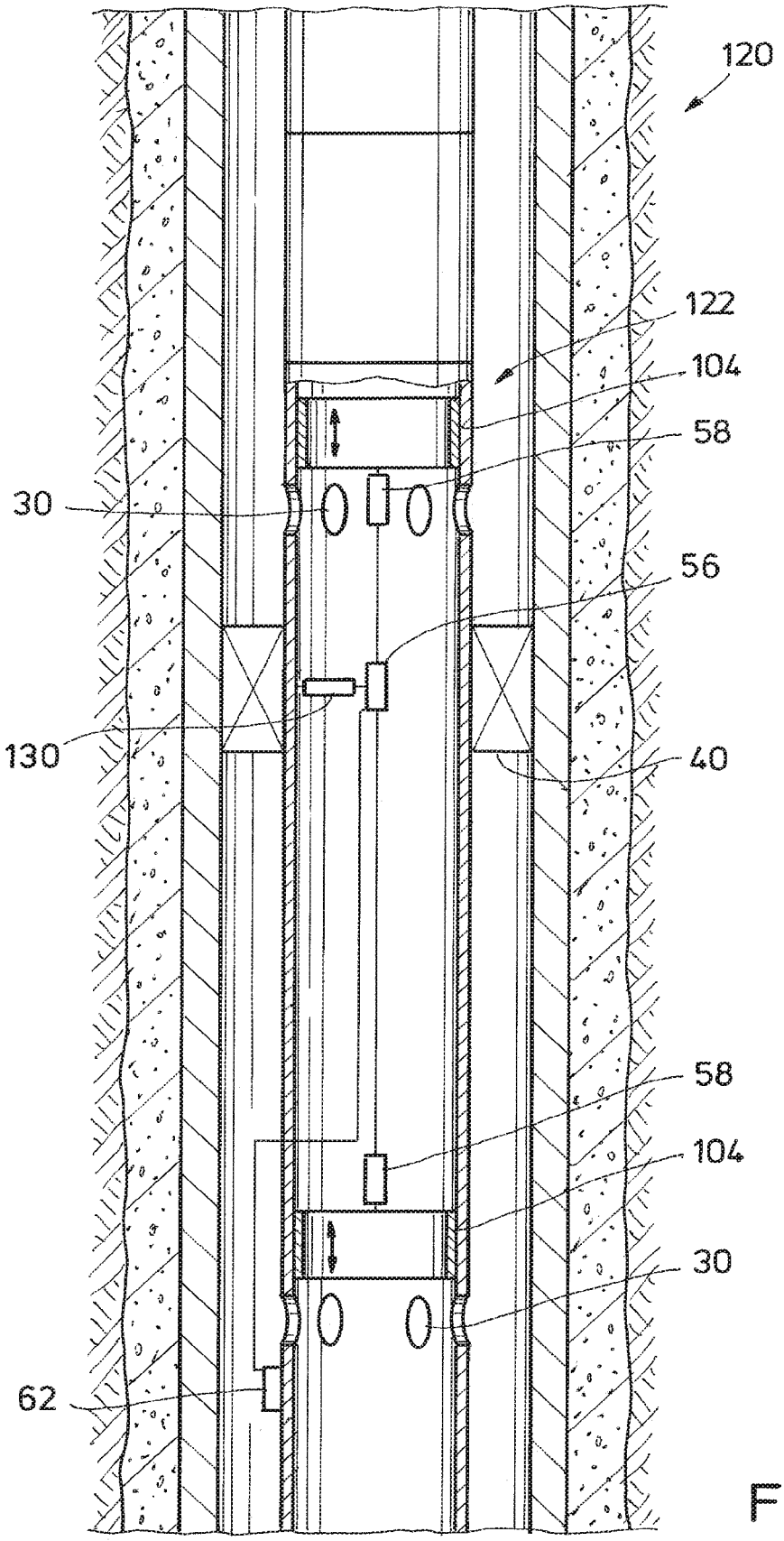

In the example embodiment of a well system 120 illustrated in FIG. 2B, a test tool 122 may be provided that extends through the isolation member 40. For example, the test tool 122 may include a ProPhase™ well test valve provided with at least one sliding sleeve 104 disposed below the isolation member 40 and at least one additional sliding sleeve 104 disposed above the isolation member 40. The downhole communication unit 56 incorporated into the test tool 122 may be operably coupled to respective actuators 58 for selectively moving the sliding sleeves 104 with respect to openings 30. Flow between the flow passageway 28 and wellbore intervals 60 and 126 below and above the isolation member 40 may thus be controlled. Sensors 62 are again positioned in communication with the wellbore interval 60 such that the sensors 62 may detect a shut-in pressure when the lower sliding sleeve 104 is in a second position where the openings 30 are obstructed.

The downhole communication unit 56 may also be operatively coupled to a setting tool 130 for setting the isolation member 40 in the wellbore 12. The setting tool 130 may include electric, mechanical and/or hydraulic pistons, motors and/or other devices operable to apply an appropriate force to the isolation member 40 to thereby radially expand the isolation member 40 as recognized in the art. In some embodiments, the setting tool 130 is responsive to an instruction signal from the downhole communication unit 56 to apply a longitudinal force to the isolation member 40 to effectively seal an annulus defined around the test string 26. The instruction signal may be an electronic signal, an acoustic signal or a pressure signal as recognized by those skilled in the art.

Figure 3:
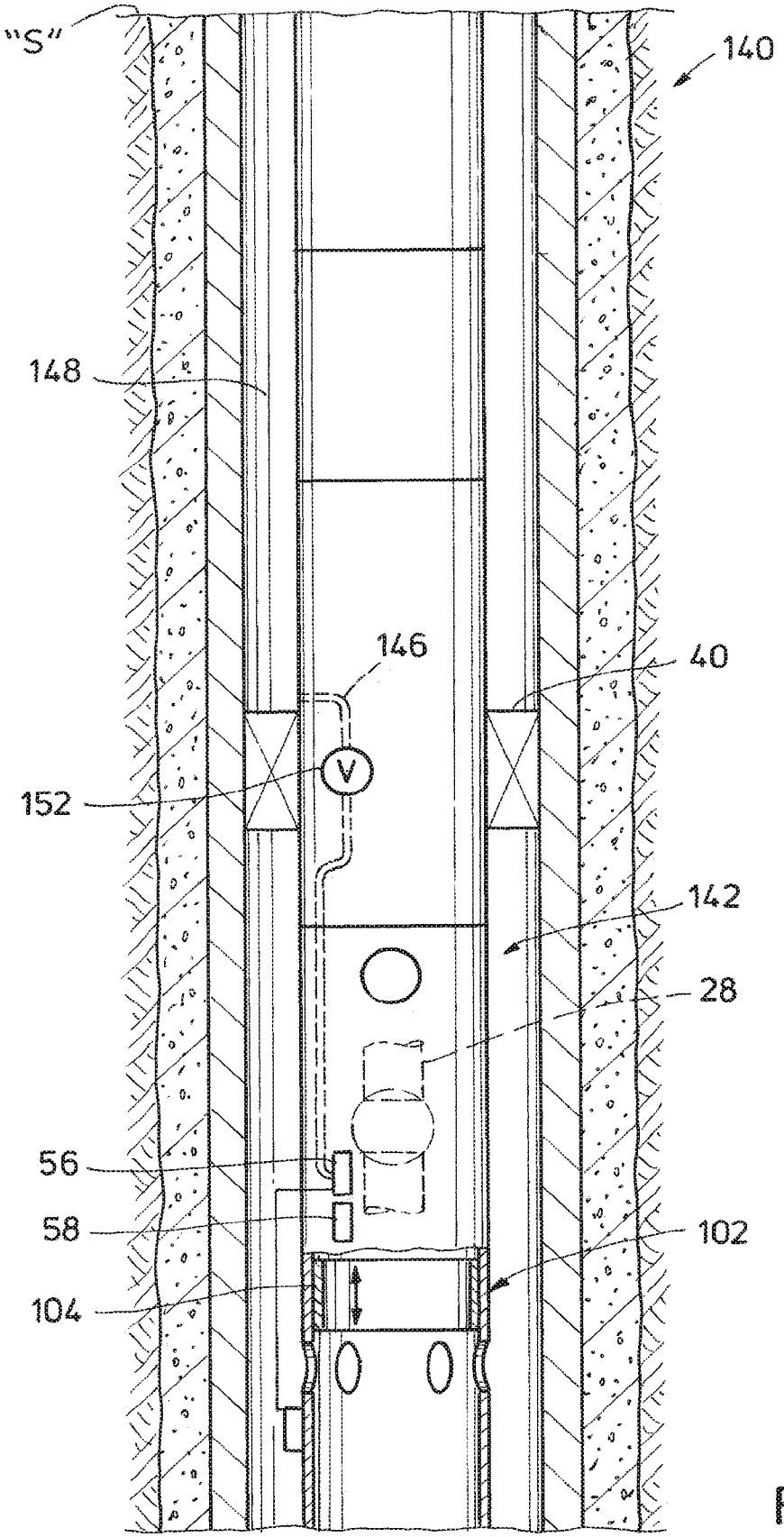
FIG. 3 is a partially cross-sectional side view of an alternate well system including a pressure conduit extending from an annulus above a production packer to tester valve below the production packer that enables activation of the tester valve by controlling the pressure in the annulus above the production packer.

FIG. 3 illustrates a well system 140 with a well test tool 142 that may be activated with annulus pressure. The well system 140 includes a conduit 146 extending between an annulus 148 above the isolation member 40 and the communication unit 56. The conduit 146 is fluidly isolated from the flow passageway 28 and provides a pressure port that permits a fluid pressure in the annulus 148 to be transmitted through the isolation member 40 to the test tool 142. A pressure signal may thus be provided to the downhole communication unit 56 by controlling the annulus pressure from the surface location "S" by any conventional methods. The downhole communication unit 56 may then, in turn, provide an instruction signal to the actuator 58 to move a closure member, e.g., sliding sleeve 104 of a tester valve 102, between open and closed configurations. Alternatively, the conduit 146 may extend directly to the actuator 58, and the annulus pressure may be transmitted to through the conduit to drive the actuator 58. A check valve 152 or other mechanism may be positioned in within the conduit 146 to selectively control the flow of annulus fluid through conduit 146.

Figure 4:
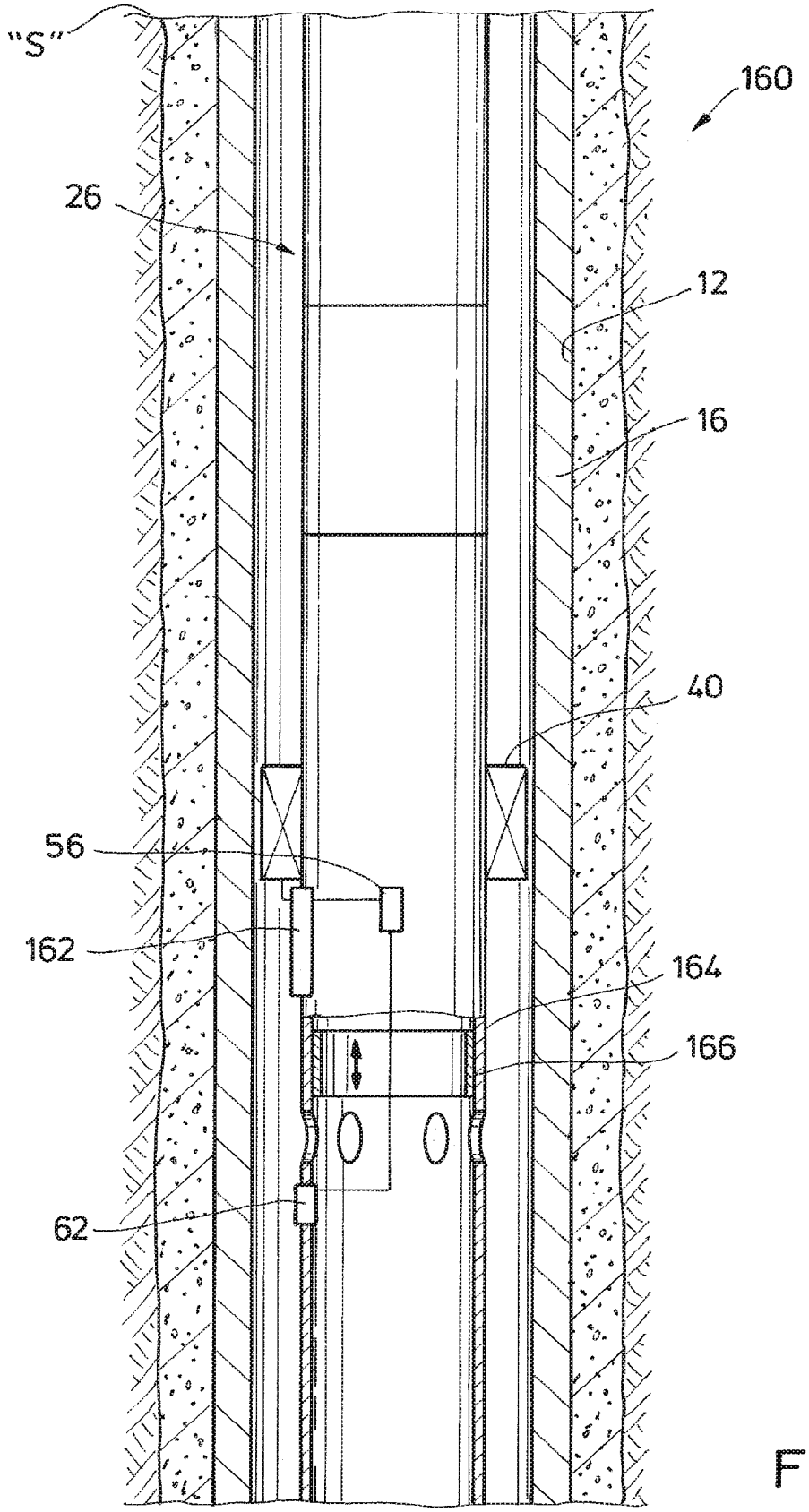
FIG. 4 is a is a partially cross-sectional side view of an alternate well system including an actuator that is operable to both set a production packer and activate the tester valve below the packer.

FIG. 4 illustrates a well system 160 including an actuator 162 that is operable to both set the isolation member 40 and activate a tester valve 164 below the isolation member 40. The actuator 162 may be operable to generate a longitudinal force, and apply the force to both the isolation member 40 and the closure member 166 of the tester valve 164, either simultaneously or sequentially. The communication unit 56 may receive a single instruction signal from the surface location "S," and then respond by providing instructions to the actuator 162 to radially expand the isolation member 40 and close the tester valve 164. Thus, the test string 26 may be run into the wellbore 12 in the illustrated configuration with the isolation member 40 in the radially retracted and spaced from the casing 16, and with the tester valve 164 tester valve in an open configuration where the openings 30 are substantially un-obstructed. Once the test string 26 is in an appropriate location in the wellbore 12, a single instruction may be supplied from the surface location "S" to shut in the wellbore interval 60. The sensors 62 are again positioned to detect the shut-in pressure in the wellbore interval 60 below the isolation member 40.

Figure 5:
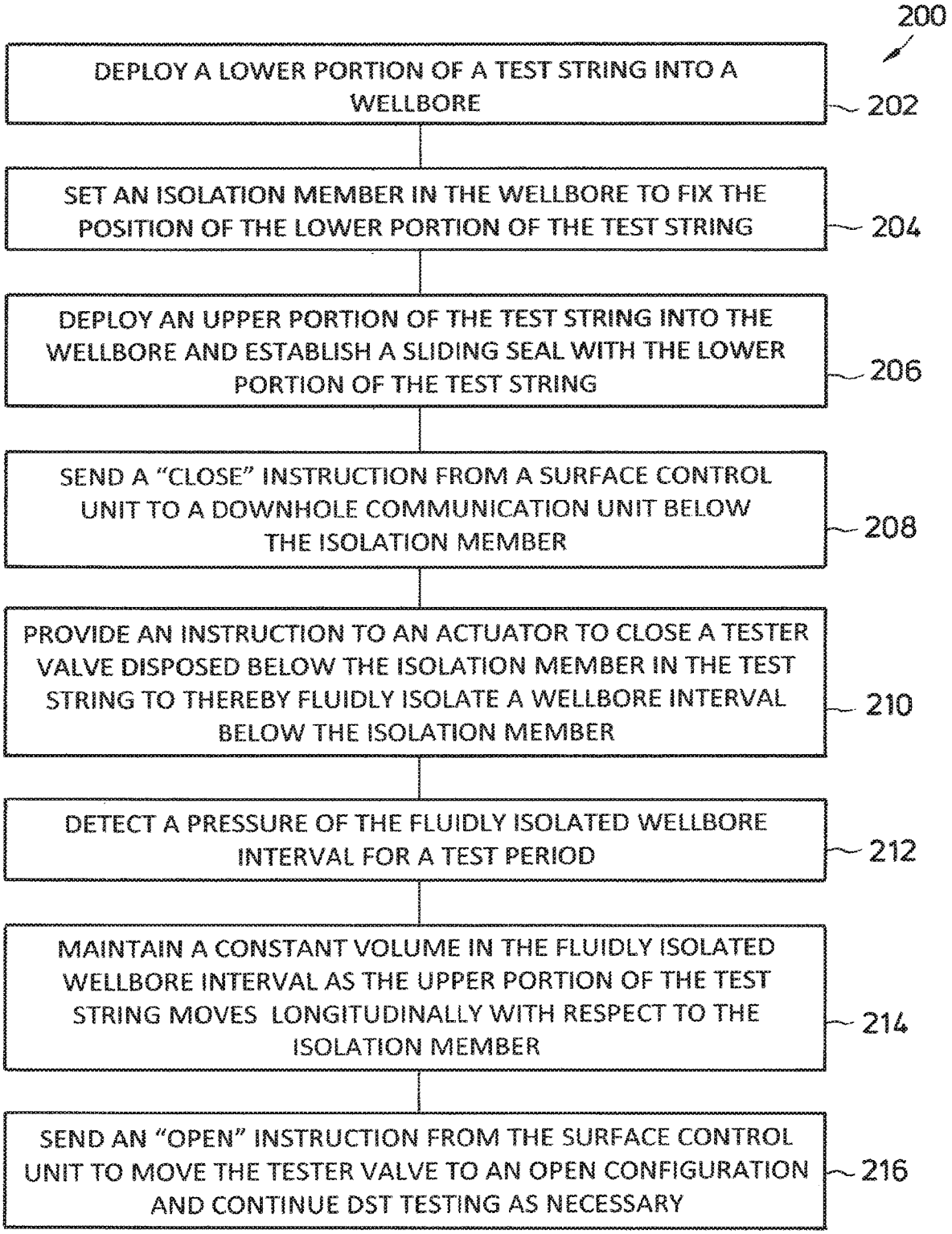
FIG. 5 is a flowchart illustrating an operational procedure for conducting a downhole shut-in test in accordance with one or more exemplary embodiments of the disclosure.

FIG. 5 is a flowchart illustrating an operational procedure 200 for deploying a test string 26 (FIG. 1) and for evaluating a wellbore 12 extending through a geologic formation "G" in a DST test procedure. With reference to FIG. 5, and with continued reference to FIG. 1, initially at step 202 the lower portion **26*l* of the test string 26 may be lowered into the wellbore 12 on a conveyance (not shown) such as a tubular string or other mechanism. The lower portion 26*l* may be run into the wellbore 12 with the isolation member 40 in the radially retracted configuration and the tester valve 32 in an open configuration. Wellbore fluids may pass freely through the openings 30 and fill the flow passageway 28. When the lower portion 26*l* of the test string 26 is in an appropriate position in the wellbore 12, the isolation member 40 may be set in the wellbore (step 204) by mechanically manipulating the conveyance, adjusting wellbore pressures, or other conventional methods for setting a packer as appreciated by those skilled in the art. Alternatively, an appropriate instruction signal may be sent from the surface control unit 54 to the downhole communication unit 56, which may then in turn instruct an actuator 58 (FIG. 3) or actuator 164 (FIG. 4) to radially expand the isolation member if the test tool is appropriately equipped. The radially expanded isolation member 40 seals the wellbore 12 and secures the lower portion 26*l* of the test string 26 therein. The conveyance may be withdrawn from the wellbore 12, and next, at step 206, the upper portion 26*u* of the test string may be lowered into the wellbore 12. The annular seals 46 at the end of the upper portion 26*u* of the test string 26 may engage the seal bore 44 of the isolation member 40. The annular seals 46 allow the flow passageway 28 to extend generally from the openings 30** to the surface location in a sealed conduit.

Next, at step 208, an instruction signal, e.g., a CLOSE instruction signal is sent from the surface control unit 54 to close the tester valve 32. The instruction signal may be sent to the downhole communication unit 56 through the isolation member 40, and may be in the form of an acoustic signal transmitted through a fluid in the flow passageway 28. The instruction signal may be received by the downhole communication unit 56. Alternatively or additionally, a pressure signal, an electrical signal, or a mechanical signal may be transmitted from above the isolation member 40 to the downhole communication unit 56.

In some embodiments, the CLOSE instruction signal may be transmitted through an annulus 148 (FIG. 3) around the upper portion 26*u* of the test string 26. The CLOSE signal may be transmitted through a conduit (146) extending through the isolation member 40 that is fluidly isolated from the flow passageway 28.

At step 210, the downhole communication unit 56 may respond to the instruction signal by providing an instruction to the tester valve 32 to move to a closed configuration. Once the tester valve 32 is in the closed configuration, flow through the flow passageway 28 is substantially prohibited by the closure member 34 of the tester valve 32, and flow in the annulus 42 is prohibited by the isolation member 40. The wellbore interval 60 is fluidly isolated, and, thus shut-in.

In some embodiments, steps 204 and 210 may be performed with a single instruction signal. For example, the actuator 162 (FIG. 4) that is operably coupled to both the isolation member 40 and the tester valve 164 may be employed to simultaneously or sequentially set the isolation member 40 and close the tester valve.

At step 212, characteristics of the wellbore interval 60 are detected with the sensors 62 for the duration of a predetermined test period. The sensors 62 may be employed to detect the shut-in fluid pressure in the wellbore interval 60 as well as other characteristics including temperature, hydrocarbon content, etc. The duration of the test period may range from several hours to several weeks. During the test period, the upper portion 26*u* of the test string 26 may expand and contract as reservoir temperatures vary. The annular seals 44 on the upper portion 26*u* of the test string 26 may move longitudinally within the seal bore 42, but since the tester valve 32 is positioned in the lower portion of the test string, the volume of the shut-in wellbore interval 60 will remain constant (step 214). The fluid pressure within the wellbore interval during the test period may thus be effectively monitored.

At step 212, the characteristics of the wellbore interval detected by the sensors 62 may be transmitted to the surface location "S." The sensors 62 may relay signals indicative of the wellbore characteristics to the downhole communication unit 56, and the downhole communication unit 56 communicates the information to the surface control unit 54. An operator may monitor the incoming information at the surface control unit during the test period, or alternatively the information may be stored in a downhole memory (not shown), and the operator may review the information after the test period once the memory has been withdrawn from the wellbore.

Next, once the test interval is complete, an appropriate instruction signal may be sent from the surface control unit 54 (step 216) to the downhole communication unit 56 to move the tester valve 32 to the open configuration. Fluid communication between the wellbore interval 60 and the flow passageway 28 may be reestablished, and DST testing may continue as necessary.

According to one aspect of the disclosure, a method for evaluating a wellbore extending through a geologic formation includes (a) deploying a test string into the wellbore, the test string including a flow passage extending longitudinally therethrough, (b) expanding an isolation member in the wellbore to seal an annulus around the test string and define a wellbore interval below the isolation member, (c) transmitting an instruction signal to a tester valve coupled in the test string below the isolation member to thereby close the tester valve and prohibit flow through the flow passage to fluidly isolate the wellbore interval below the isolation member, and (d) detecting a shut-in pressure within the wellbore interval below the isolation member for the duration of a test period while wellbore interval is fluidly isolated.

In some embodiments, deploying the test string into the wellbore further comprises establishing a sliding seal between upper and lower portions of the test string in the wellbore such that the tester valve is coupled in the lower portion of the test string and is held stationary in the wellbore by the isolation member, and such that the upper portion of the test string is permitted to move longitudinally with respect to the isolation member without breaking the sliding seal. The method may further include transmitting a signal indicative of the shut-in pressure to a surface location during the test period.

Transmitting the instruction signal to the tester valve may further include transmitting an acoustic signal through the flow passageway and through the isolation member. Transmitting the instruction signal to the tester valve further include controlling an annulus pressure above the isolation member and transmitting the annulus pressure through a conduit extending through the isolation member.

In some embodiments, the method may further include shifting a sliding sleeve to obstruct an opening defined between the flow passageway and the wellbore interval below the isolation member to thereby prohibit flow through the flow passage.

In one or more exemplary embodiments, the method according to claim 1, further includes responding to the instruction signal to both expand the isolation member in the wellbore and close the tester valve. The method may further include instructing a single actuator operably coupled to both the isolation member and the tester valve to move to thereby expand the isolation member and close the tester valve.

According to another aspect, the disclosure is directed to a drill stem testing system for evaluating a wellbore extending through a geologic formation. The system includes a tubular test string having a flow passage extending longitudinally therethrough and an isolation member disposed about the tubular test string. The isolation member is selectively operable to seal an annulus around the tubular test string when installed in a wellbore. A tester valve is coupled in the tubular test string below the isolation member. The tester valve has an open configuration where flow through the flow passageway is permitted and a closed configuration where flow through the flow passageway is prohibited. A downhole communication unit is provided below the isolation member and is operable to receive an instruction signal from above the isolation member and respond by providing an instruction to the tester valve to move between the open and closed configurations to thereby isolate a wellbore interval below the isolation member.

In some embodiments, the test string further includes a sliding seal established between upper and lower portions of the test string. The isolation member and the tester valve may be both coupled in the lower portion of the tubular test string in a fixed spatial relation to one another.

In one or more embodiments, the lower portion of the tubular test string further includes at least one sensor for detecting a shut-in pressure within a wellbore interval below the isolation member, and the at least one sensor may be communicatively coupled to the downhole communication unit. The drill stem testing system may further include a surface control unit operable to generate an acoustic instruction signal, and the downhole communication unit may be operable to receive the acoustic instruction signal and respond by providing the instruction to the tester valve.

The drill stem testing system may further include a conduit extending through the isolation member that is fluidly isolated from the fluid flow passageway. The conduit may be operable to transmit an annulus pressure above the isolation member to the downhole communication unit below the isolation member.

In one or more example embodiments, the drill stem testing may include a single actuator operably coupled to both the isolation member and the tester valve. The single actuator may be operable to receive a single instruction signal and respond by radially expanding the isolation member and closing the tester valve. The single actuator may be operable to generate a longitudinal force, and apply the longitudinal force to both the isolation member and the tester valve in some example embodiments.

The drill stem testing system may further include at least one additional valve coupled in the test string above the isolation member. The at least one additional valve may be operably coupled to the downhole communication unit.

According to another aspect, the disclosure is directed to a method for evaluating a wellbore extending through a geologic formation. The method includes (a) deploying a lower portion of a test string into the wellbore, the lower portion of the test string including a seal bore at an upper end thereof (b) expanding an isolation member in the wellbore to seal an annulus around the lower portion of the test string and define a wellbore interval below the isolation member, (c) deploying an upper portion of a the test string into the wellbore to engage the seal bore and establish a sealed flow passageway extending between the upper and lower portions of the test string (d) closing a tester valve coupled in the lower portion of test is string below the isolation member to thereby prohibit flow through the flow passage and fluidly isolate the wellbore interval below the isolation member, and (e) detecting a shut-in pressure within the wellbore interval below the isolation member for the duration of a test period while wellbore interval is fluidly isolated.

In some embodiments, the method further includes moving the upper portion of the test string longitudinally within the seal bore during the test period and maintaining a constant volume of the wellbore interval below the isolation member throughout the test period. The method may further include transmitting an acoustic signal through the isolation member to thereby close the tester valve.

In some embodiments, the shut in pressure may be detected with sensors coupled to the lower portion **26*l* of the test string 26**. In other embodiments, the sensors may be deployed into the wellbore on a wireline or slickline.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the a Such modifications and adaptations are in the spirit and scope of the disclosure.

What is claimed is:

1. A method for evaluating a wellbore extending through a geologic formation, the method comprising:

deploying a test string into the wellbore, the test string including a flow passage extending longitudinally therethrough;

expanding an isolation member in the wellbore to seal an annulus around the test string and define a wellbore interval below the isolation member;

transmitting an instruction signal to a tester valve coupled in the test string below the isolation member to thereby close the tester valve and prohibit flow through the flow passage to fluidly isolate the wellbore interval below the isolation member; and detecting a shut-in pressure within the wellbore interval below the isolation member for the duration of a test period while wellbore interval is fluidly isolated;

wherein deploying the test string into the wellbore further comprises establishing a sliding seal between upper and lower portions of the test string in the wellbore such that the tester valve is coupled in the lower portion of the test string and is held stationary in the wellbore by the isolation member, and such that the upper portion of the test string is permitted to move longitudinally with respect to the isolation member without breaking the sliding seal.

2. The method according to claim 1, further comprising transmitting signal indicative of the shut-in pressure to a surface location during the test period.

3. The method according to claim 1, wherein transmitting the instruction signal to the tester valve further comprises transmitting an acoustic signal through the flow passageway and through the isolation member.

4. The method according to claim 1, wherein transmitting the instruction signal to the tester valve further comprises controlling an annulus pressure above the isolation member and transmitting the annulus pressure through a conduit extending through the isolation member.

5. The method according to claim 1, further comprising shifting a sliding sleeve to obstruct an opening defined between the flow passageway and the wellbore interval below the isolation member to thereby prohibit flow through the flow passage.

6. The method according to claim 1, further comprising responding to the instruction signal to both expand the isolation member in the wellbore and close the tester valve.

7. The method according to claim 1, further comprising instructing a single actuator operably coupled to both the isolation member and the tester valve to move to thereby expand the isolation member and close the tester valve.

8. A drill stem testing system for evaluating a wellbore extending through a geologic formation, the system comprising:

a tubular test string having a flow passage extending longitudinally therethrough;

an isolation member disposed about the tubular test string, the isolation member selectively operable to seal an annulus around the tubular test string when installed in a wellbore;

a tester valve coupled in the tubular test string below the isolation member, the tester valve having an open configuration where flow through the flow passageway is permitted and a closed configuration where flow through the flow passageway is prohibited; and a downhole communication unit operable to receive an instruction signal from above the isolation member and respond by providing an instruction to the tester valve to move between the open and closed configurations to thereby isolate a wellbore interval below the isolation member;

wherein the test string further comprises a sliding seal established between upper and tower portions of the test string.

9. The drill stern testing system according to claim 8, wherein the isolation member and the tester valve are both coupled in the lower portion of the tubular test string in a fixed spatial relation to one another.

10. The drill stem testing system according to claim 8, wherein the lower portion of the tubular test string further comprises at least one sensor for detecting a shut-in pressure within a wellbore interval below the isolation member, the at least one sensor communicatively coupled to the downhole communication unit.

11. The drill stem testing system according to claim 8, further comprising a surface control unit operable to generate an acoustic instruction signal, and wherein the downhole communication unit is operable to receive the acoustic instruction signal and respond by providing the instruction to the tester valve.

12. The drill stem testing system according to claim 8, further comprising a conduit extending through the isolation member and fluidly isolated from the fluid flow passageway, the conduit operable to transmit an annulus pressure above the isolation member to the downhole communication unit below the isolation member.

13. The drill stem testing system according to claim 8, further comprising a single actuator operably coupled to both the isolation member and the tester valve, the actuator operable to receive a single instruction signal and respond by radially expanding the isolation member and closing the tester valve.

14. The drill stem testing system according to claim 13, wherein the single actuator is operable to generate a longitudinal force, and apply the longitudinal force to both the isolation member and the tester valve.

15. The drill stem testing system according to claim 8, further comprising at least one additional valve coupled in the test string above the isolation member, the at least one additional valve operably coupled to the downhole communication unit.

16. A method for evaluating a wellbore extending through a geologic formation, the method comprising:

deploying a lower portion of a test string into the wellbore, the lower portion of the test string including a seal bore at an upper end thereof;

expanding an isolation member in the wellbore to seal an annulus around ower portion of the test string and define a wellbore interval below the isolation member;

deploying an upper portion of the test string into the wellbore to engage the seal bore and establish a sealed flow passageway extending between the upper and lower portions of the test string;

closing a tester valve coupled in the lower portion of test string below the isolation member to thereby prohibit flow through the flow passage and fluidly isolate the wellbore interval below the isolation member: and detecting a shut-in pressure within the wellbore interval below the isolation member for the duration of a test period while wellbore interval is fluidly isolated.

17. The method according to claim 16, further comprising moving the upper portion of the test string longitudinally within the seal bore during the test period and maintaining a constant volume of the wellbore interval below the isolation member throughout the test period.

18. The method according to claim 16, further comprising transmitting an acoustic signal through the isolation member to thereby close the tester valve.

19. The method according to claim 16, further comprising controlling an annulus pressure above the isolation member and transmitting the annulus pressure through the isolation member to thereby close the tester valve.

20. The method according to claim 16, further comprising transmitting a signal indicative of the shut-in pressure to a surface location during the test period.

* * * * *